US010570629B1

(12) United States Patent
Chen

(10) Patent No.: US 10,570,629 B1
(45) Date of Patent: Feb. 25, 2020

(54) EDGE FINISHING STRUCTURE

(71) Applicants: SHAN YEUN CO,. LTD., Yilan County (TW); 2145677 Alberta Ltd., Edmonton, AB (CA)

(72) Inventor: Wen-Chi Chen, Yilan County (TW)

(73) Assignees: SHAN YEUN CO., LTD., Yilan County (TW); 2145677 ALBERTA LTD., Edmonton, AB (CA)

( * ) Notice: Subject to any disclaimer, the term of this patent is extended or adjusted under 35 U.S.C. 154(b) by 0 days.

(21) Appl. No.: 16/234,461

(22) Filed: Dec. 27, 2018

(51) Int. Cl.

| | |
|---|---|
| ***E04F 19/06*** | (2006.01) |
| ***E04F 15/02*** | (2006.01) |
| ***E04F 15/04*** | (2006.01) |
| ***E04F 13/26*** | (2006.01) |
| ***E04F 11/16*** | (2006.01) |
| ***E04F 19/02*** | (2006.01) |

(52) U.S. Cl.
CPC ..... *E04F 19/061* (2013.01); *E04F 11/166* (2013.01); *E04F 13/26* (2013.01); *E04F 15/02044* (2013.01); *E04F 15/048* (2013.01); *E04F 19/02* (2013.01); *E04F 19/066* (2013.01)

(58) Field of Classification Search
CPC ..... E04F 19/061; E04F 19/06; E04F 19/02; E04F 19/065; E04F 19/066; E04F 11/166; E04F 15/02044; E04F 13/26; E04F 15/048
See application file for complete search history.

(56) References Cited

U.S. PATENT DOCUMENTS

| | | | | |
|---|---|---|---|---|
| 3,421,274 | A * | 1/1969 | Reiff | E04F 11/166 52/179 |
| 8,087,209 | B2 * | 1/2012 | Sondermann | E04F 19/066 52/288.1 |
| 8,266,865 | B2 * | 9/2012 | Neuhofer, Jr. | E04F 19/061 52/716.8 |
| 8,572,919 | B1 * | 11/2013 | Neill | E04F 19/061 52/466 |
| 8,966,858 | B2 * | 3/2015 | Sondermann | E04F 19/061 16/16 |
| 9,260,871 | B2 * | 2/2016 | Shaw | E04F 19/061 |
| 2003/0084634 | A1 * | 5/2003 | Stanchfield | E04F 15/02005 52/464 |
| 2006/0016136 | A1 * | 1/2006 | Moller, Jr. | E04F 15/10 52/177 |

(Continued)

*Primary Examiner* — Adriana Figueroa
*Assistant Examiner* — Jessie T Fonseca
(74) *Attorney, Agent, or Firm* — Leong C. Lei

(57) ABSTRACT

An edge finishing structure includes a spring plate base and an edge trimmer strip. The spring plate base includes a hook-up seat, an intermediate plate extending from a lower end of the hook-up seat, and a stop plate connected to the intermediate plate. The spring plate base is also provided with at least one coupling unit. The edge trimmer strip has a bottom portion mounted on the hook-up seat and the intermediate plate. The bottom portion is formed with a positioning groove corresponding to the hook-up seat. As such, the spring plate base and the edge trimmer strip can be mounted to an external circumference of board member. Various advantages can be achieved, including easily mounting of the edge trimmer strip, causing no deterioration to an outside appearance of the edge trimmer strip, and enhancing flexibility of variation of stylish shaping on a top portion of the edge trimmer strip.

18 Claims, 10 Drawing Sheets

(56) References Cited

U.S. PATENT DOCUMENTS

| | | | | |
|---|---|---|---|---|
| 2006/0196135 | A2* | 9/2006 | Stanchfield | E04F 15/02005 52/459 |
| 2006/0260241 | A1* | 11/2006 | Stanchfield | E04D 1/365 52/459 |
| 2008/0216428 | A1* | 9/2008 | Carvalhais | E04F 19/061 52/312 |
| 2009/0266021 | A1* | 10/2009 | Neuhofer, Jr. | E04F 19/061 52/468 |
| 2015/0374264 | A1* | 12/2015 | Haas | G01V 9/00 73/862.541 |

* cited by examiner

EDGE FINISHING STRUCTURE

TECHNICAL FIELD OF THE INVENTION

The present invention relates generally to a technical field of edge finishing that is applied to a circumference of a wood board.

DESCRIPTION OF THE PRIOR ART

Wood boards are commonly jointed together to make a floor board or a wall board to separate different spaces that is applied to household interior decoration or for visual effect of building landscape. Referring to FIG. 1, boards 91 are laid, one by one, on a riser plate 92. After the operation of laying is completed, a decoration board 93 is attached to outer ends of the boards to cover undesired gaps and end shapes of the outer ends of the boards 91, in order to provide a complete and good-looking construction.

Such known technique suffers at least the following drawbacks:

(1) The decoration board 93 is fixed to the riser board 92 or the boards 91 by screws 94. Such a structural arrangement must be made by using a hand tool, such as a spanner or a screwdriver, so that the operation is time inefficient and tedious.

(2) After being fastened and fixed, heads of the screws 94 are often exposed and this deteriorates the outside looking of the decoration board 93. A plug 95 is often used as a cover, but this still affects the outside looking of the decoration board 93.

(3) The decoration board 93 is mounted to the riser boards 92 or the laid boards 91 with a major surface that has a large surface area. Due to such an arrangement, a top edge of the top board 93 that may be formed with a three-dimensional configuration is of a very limited surface area, leaving only very limited number of options for outside looking available for such an arrangement.

(4) Since the decoration board 93 is mounted to the rise board 92 or the laid boards 91 with the major surface that has a large surface area, it is difficult to reduce the overall size it may take. Consequently, the cost is high.

The present invention is made to overcome the above-discussed problems.

SUMMARY OF THE INVENTION

The present invention aims to provide an edge finishing structure that is made up of a spring plate base and an edge trimmer strip.

The spring plate base comprises a hook-up seat, an intermediate plate extending outward from one side of a lower end of the hook-up seat, and a stop plate connected to an outer side of the intermediate plate. The spring plate base is also provided with at least one coupling unit at a suitable location.

The edge trimmer strip has a bottom portion that is provided with a positioning groove corresponding to the hook-up seat to allow the edge trimmer strip to be set on and mounted to the hook-up seat and the intermediate plate.

As such, the present invention provides an edge trimmer strip that shows various advantages, including being easy to mount, not causing deterioration of an outside appearance of the edge trimmer strip, and enhancing flexibility of variation of stylish shaping on a top portion of the edge trimmer strip.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
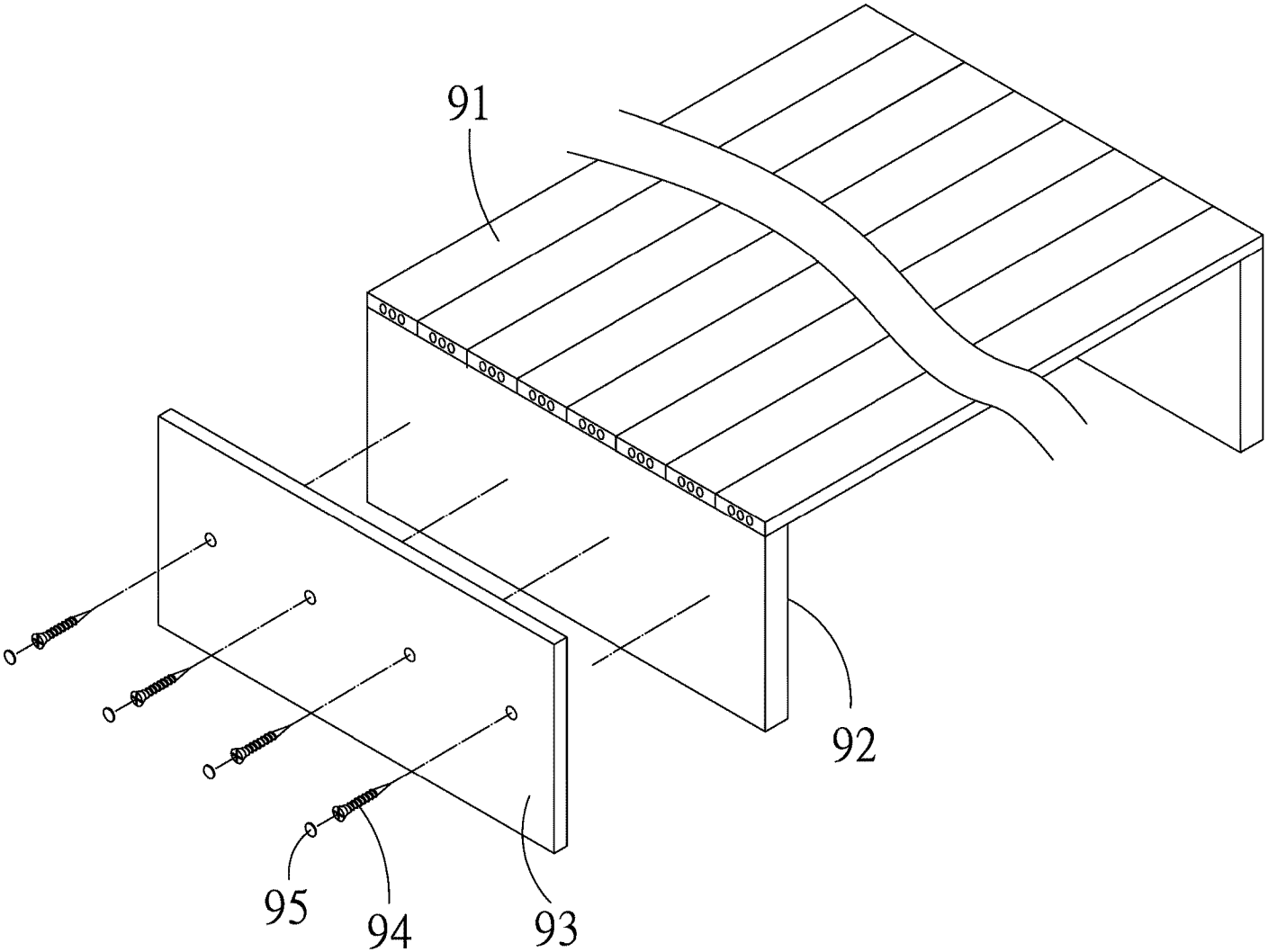
PRIOR ART FIG. 1
FIG. 1 is a perspective view showing prior art.
Figure 2:
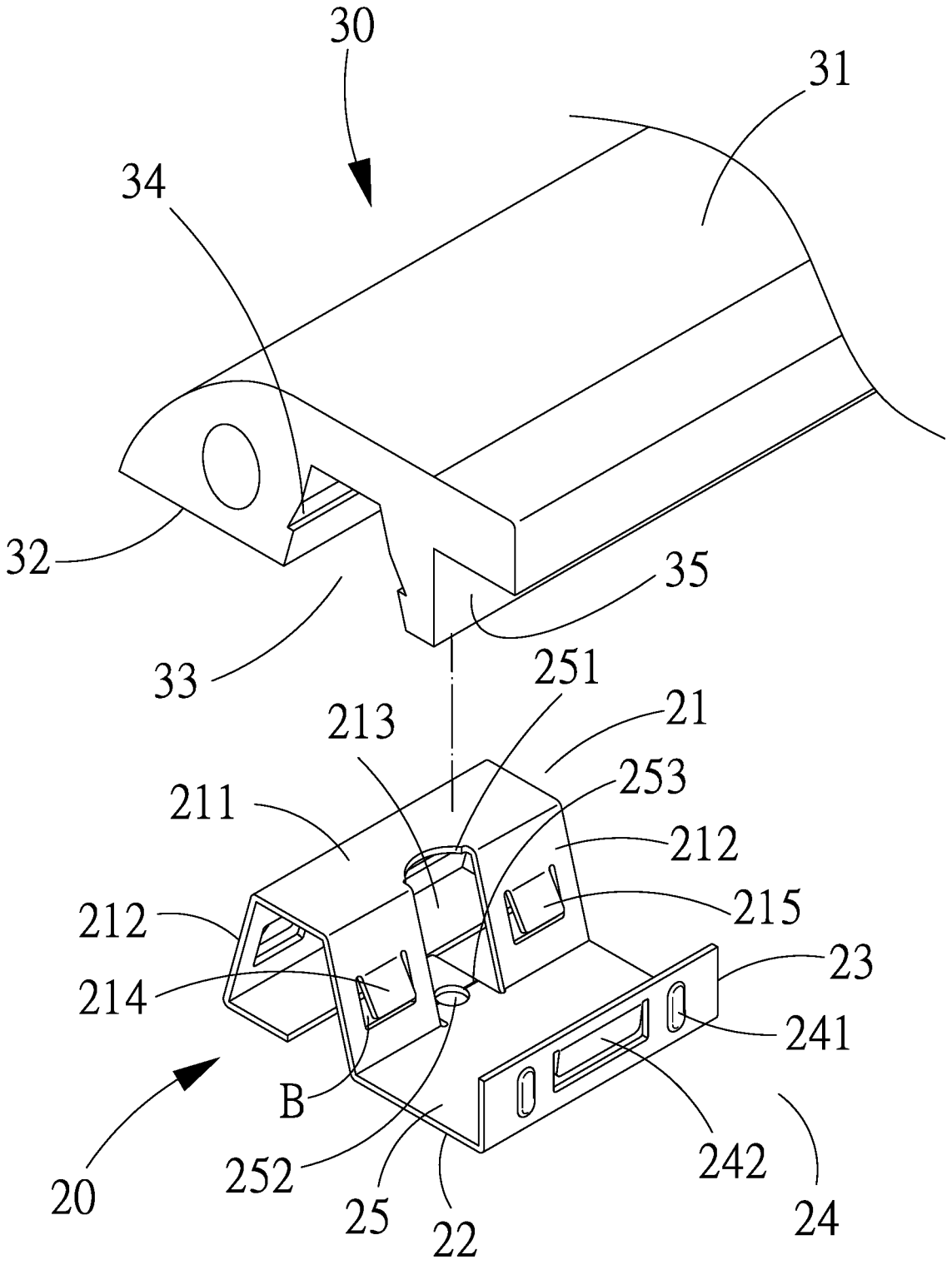
FIG. 2 is a perspective view showing a spring plate base and a trimmer strip according to the present invention in a condition of being detached from each other.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 2-6, a floor board or a wall board is made up of a plurality of elongate board members 10 jointed together. The present invention provides an edge finishing structure for attaching to a circumference of the board members 10. The edge finishing structure comprises a plurality of spring plate base 20 and edge trimmer strips 30.

The board member 10 is made in the form of a dual-layered structure comprising a foundation layer 11 and an extruding layer 12. The foundation layer 11 is formed as a plastic molding and is formed with a guide slot 111 that has an opening facing downward in an outer edge portion thereof The guide slot 111 is provided, in an upper portion thereof, with a barb space 112. The extruding layer 12 is stacked on a top surface of the foundation layer 11.

The spring plate base 20 at least comprises a hook-up seat 21, an intermediate plate 22 extending outward from one side of a lower end of the hook-up seat 21, a stop plate 23 connected to an outer side of the intermediate plate 22, a first coupling unit 24 provided in the stop plate 23, and a second coupling unit 25 arranged in a range of the hook-up seat 21. The hook-up seat 21 is metallic hollow frame having a cross-section that is a trapezoidal configuration including a top wall 211, two opposite side walls 212, and a bottom wall 213. The two side walls 212 each have a front portion and a rear portion each of which is formed with a U-shaped punched hole B having a top side that is not cut off so as to form awning window shaped front hook-up tab 214 and rear hook-up tab 215, respectively, in such a way that the front hook-up tab 214 and the rear hook-up tab 215 project outward of an outside surface of the side wall 212 in downward extension thereof The intermediate plate 22 extend outward, in a horizontal direction, from a right side of a bottom end of the hook-up seat 21. The stop plate 23 extend upward, in a vertical direction, from a right end of the intermediate plate 22. The first coupling unit 24 comprises two preloading blocks 241 that are formed on the stop plate 23 through pressing to protrude rightward and a U-shaped punched hole B arranged between the two preloading blocks 241 and having a top side that is not cut off so as to form an awning window shaped barb tab 242. The barb tab 242 projects outward of a left side of the stop plate 23 in downward extension thereof. The two preloading blocks 241 and the barb tab 242 can be forced to insert, in an upward direction, into the guide slot 111 of the board members 10 to be released in the barb space 112, such that the barb tab 242 can be fixed and prevented from moving, in a reversed direction, in the barb space 112, to thereby fix the hook-up seat 21 to the outer circumference of the board members 10. The second coupling unit 25 comprises a downward-recessed opening 251 formed in the top wall 211 and the side walls 212 of the hook-up seat 21 and a coupling hole 252 formed in and penetrating through the bottom wall 213 of the hook-up seat 21 to correspond to the opening 251. The bottom wall 213 is also provided, in each of a front side and a rear side of a center of the coupling hole 252, with a V-shaped groove marking section 253.

The edge trimmer strips 30 each have a top portion 31 and a bottom portion 32 having a relatively large surface area. The bottom portion 32 is set on and mounted to the hook-up seat 21 and the intermediate plate 22. The bottom portion 32 is also formed with a positioning groove 33 corresponding to the hook-up seat 21. The positioning groove 33 is provided therein with retaining notches 34 that function to engage the front hook-up tab 214 and the rear hook-up tab 215 through elastic deformation so that the edge trimmer strip 30 can be mounted in a time efficient manner by just having the retaining notches 34 engaging and retaining the front hook-up tab 214 and the rear hook-up tab 215 in position, without using any hand tool.

Figure 3:
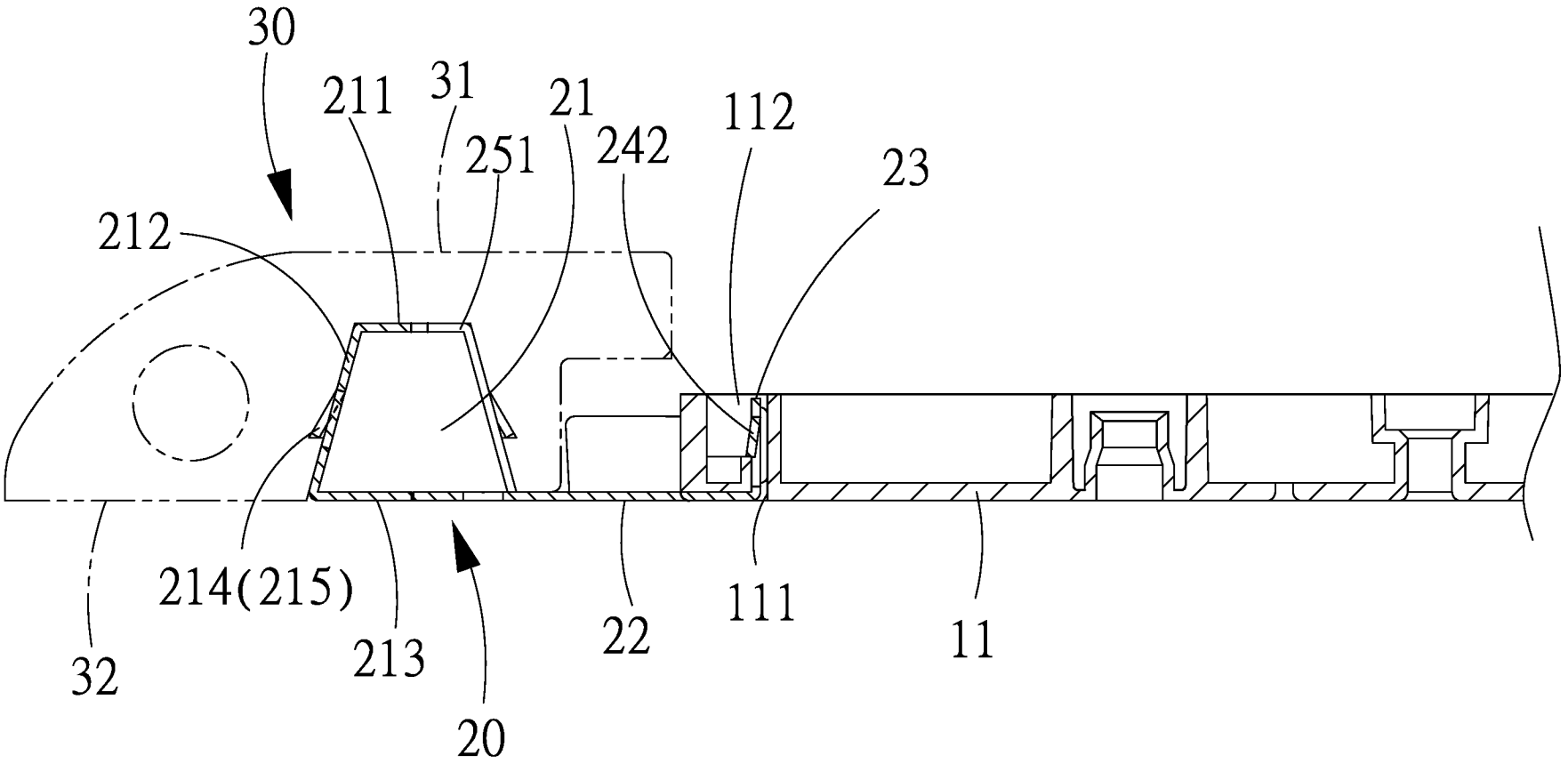
FIG. 3 is a cross-sectional view showing the spring plate base and a board foundation layer of the present invention in a condition of being assembled together.
Figure 4:
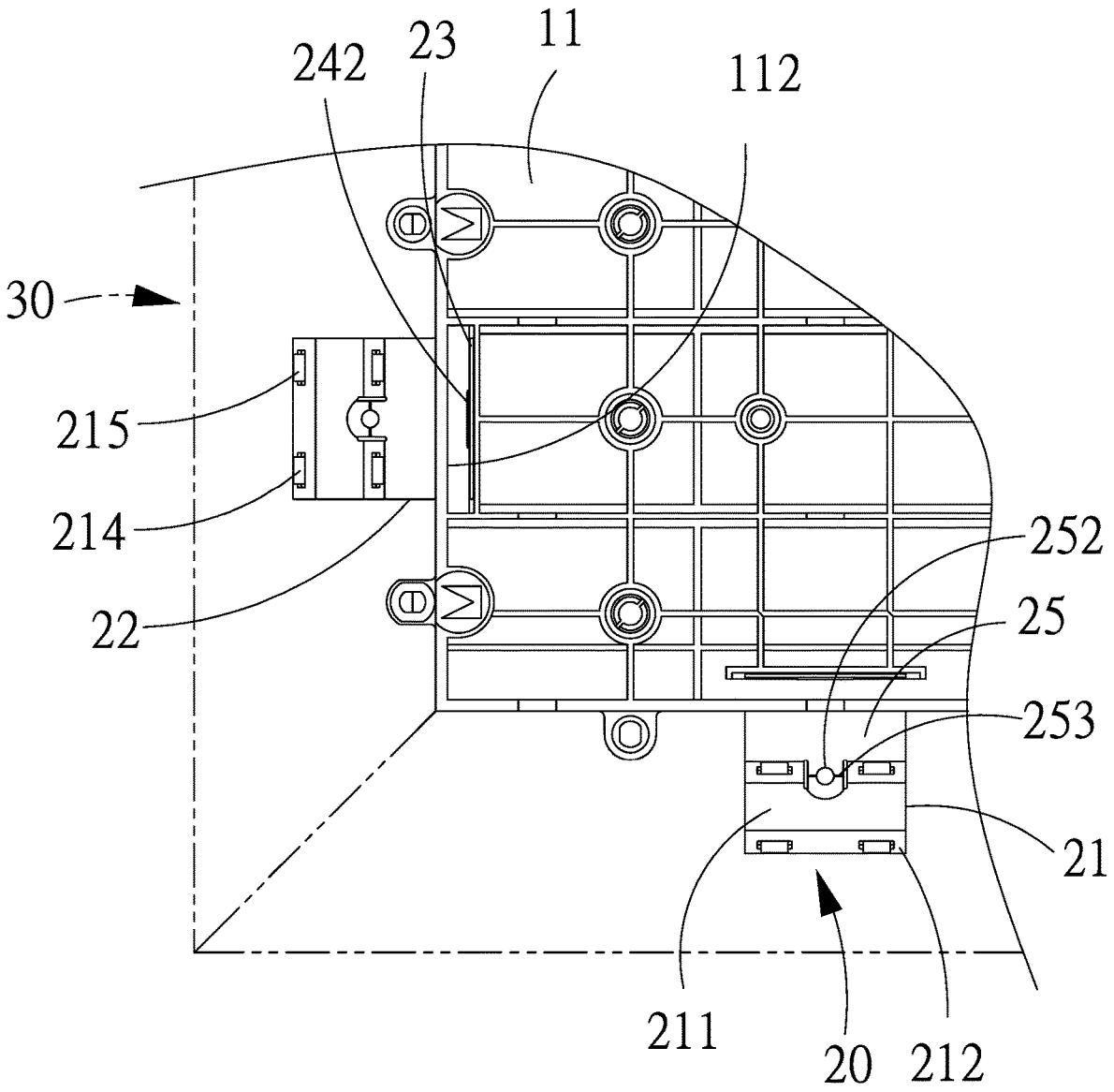
FIG. 4 is a top plan view of FIG. 3.
Figure 5:
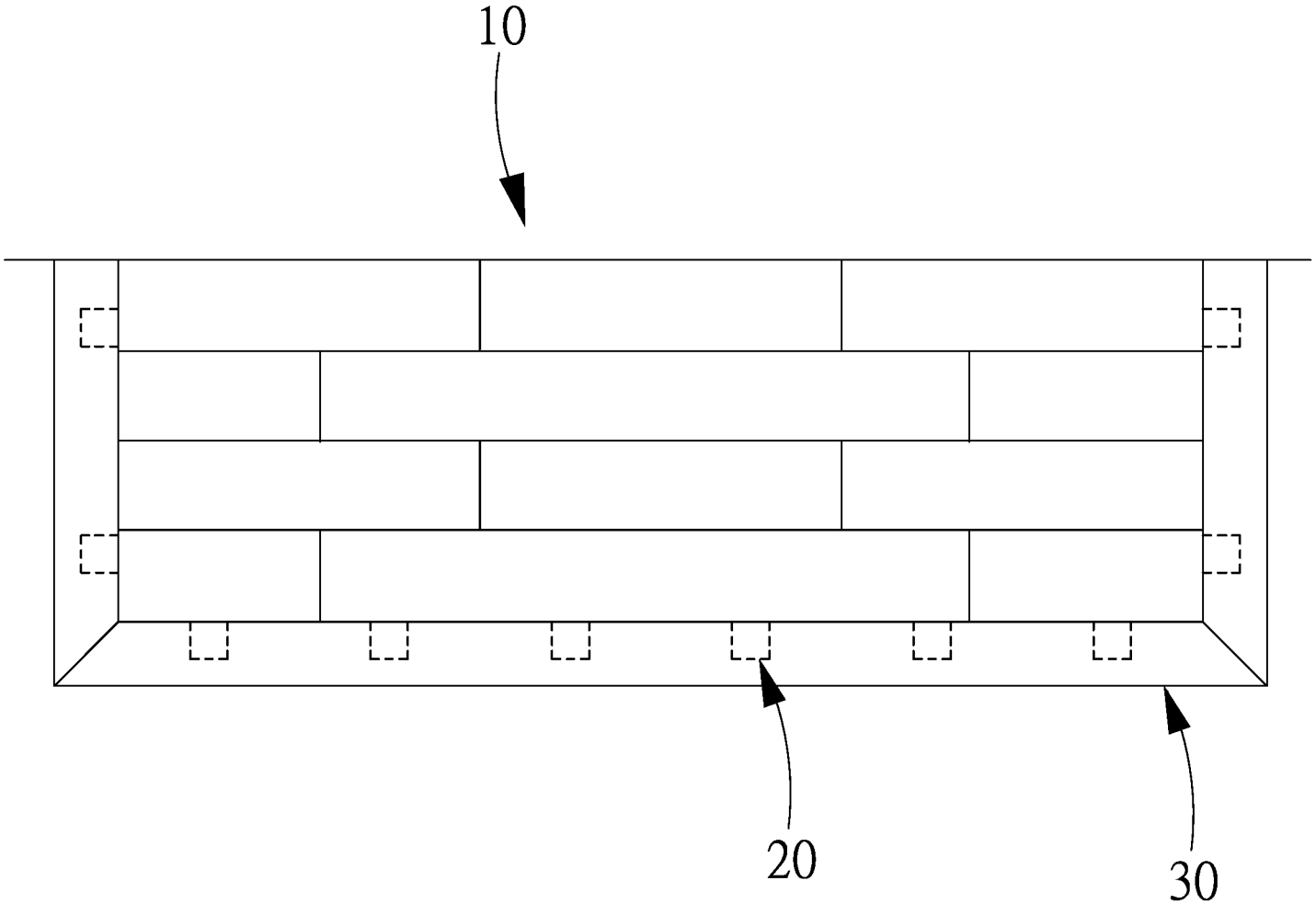
FIG. 5 is a schematic view illustrating an embodiment of the present invention.
Figure 6:
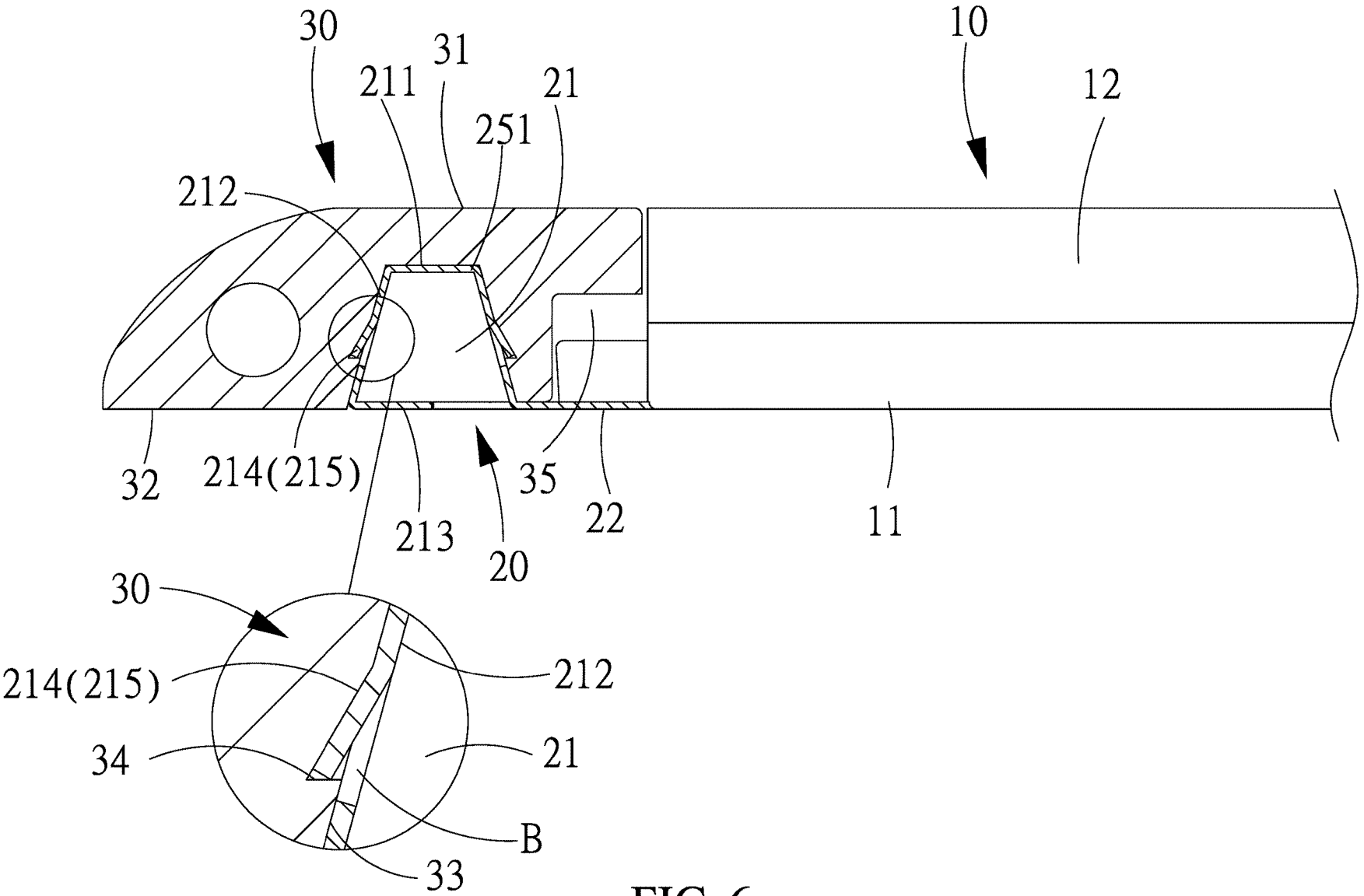
FIG. 6 is a cross-sectional view showing a portion of FIG. 5 in an assembled form.
Figure 7:
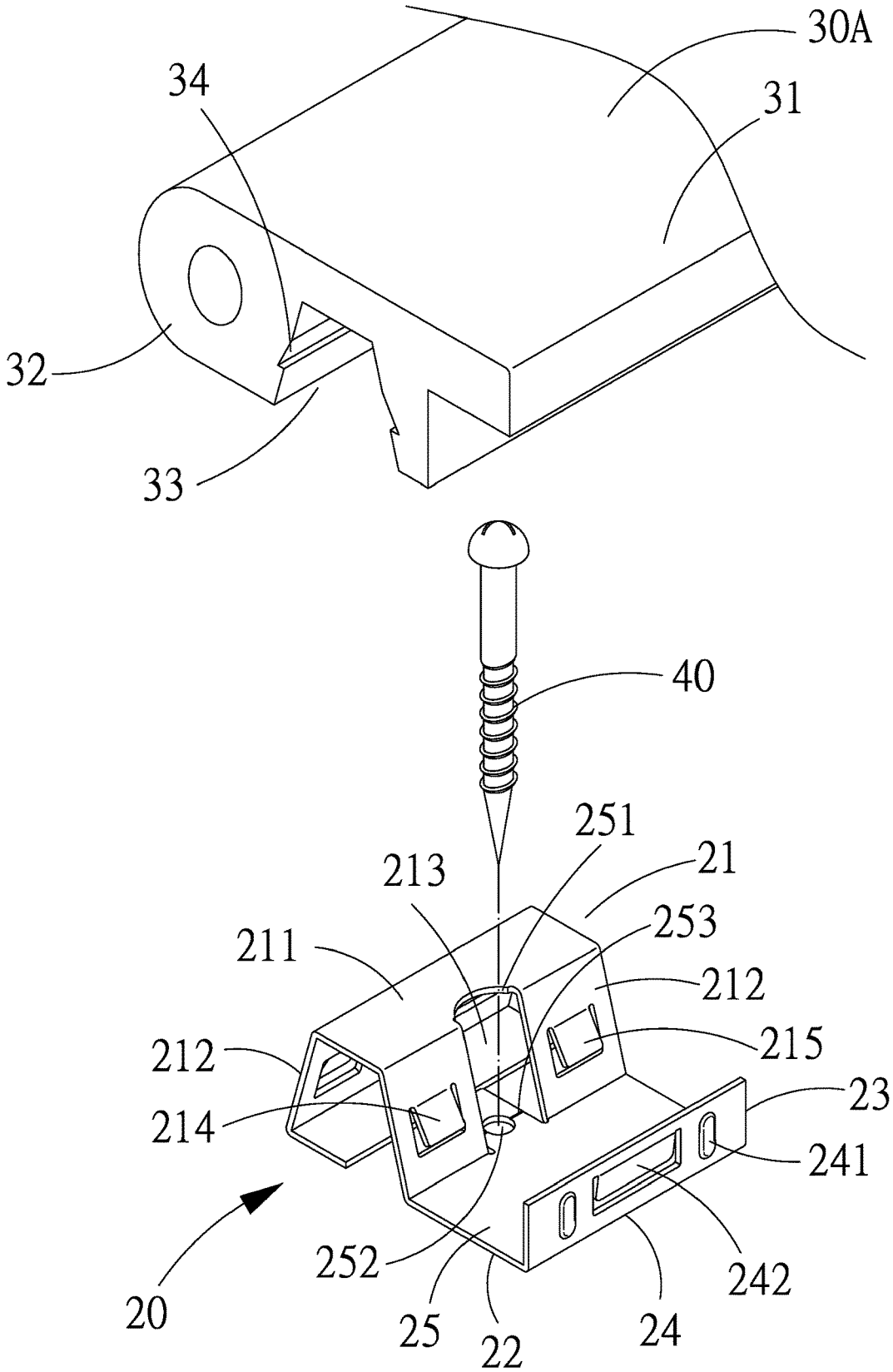
FIG. 7 is a perspective view showing a spring plate base, an edge trimmer strip, and a mounting screw according to another embodiment of the present invention.
Figure 8:
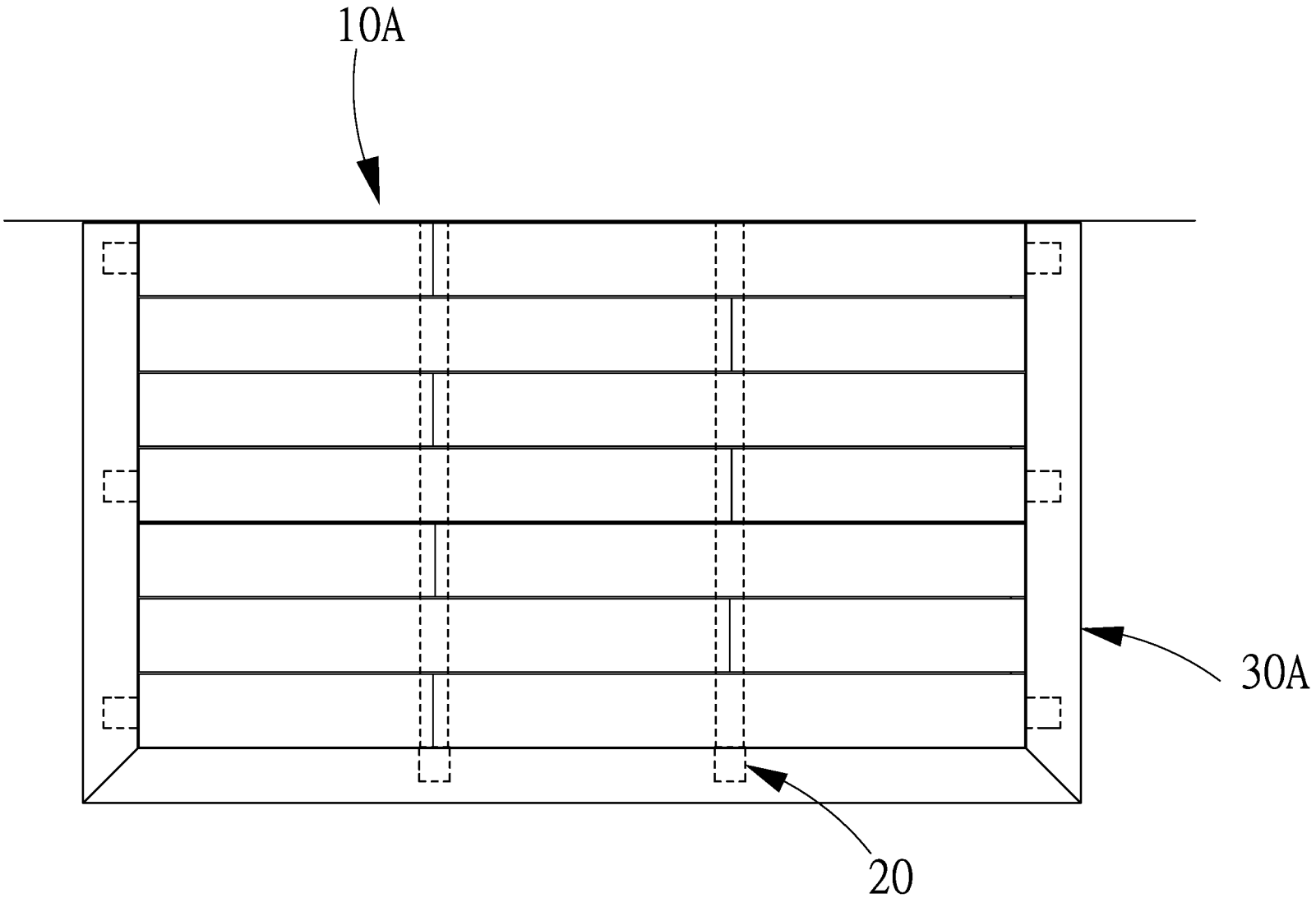
FIG. 8 is a top plan view of the embodiment shown in FIG. 7.
Figure 9:
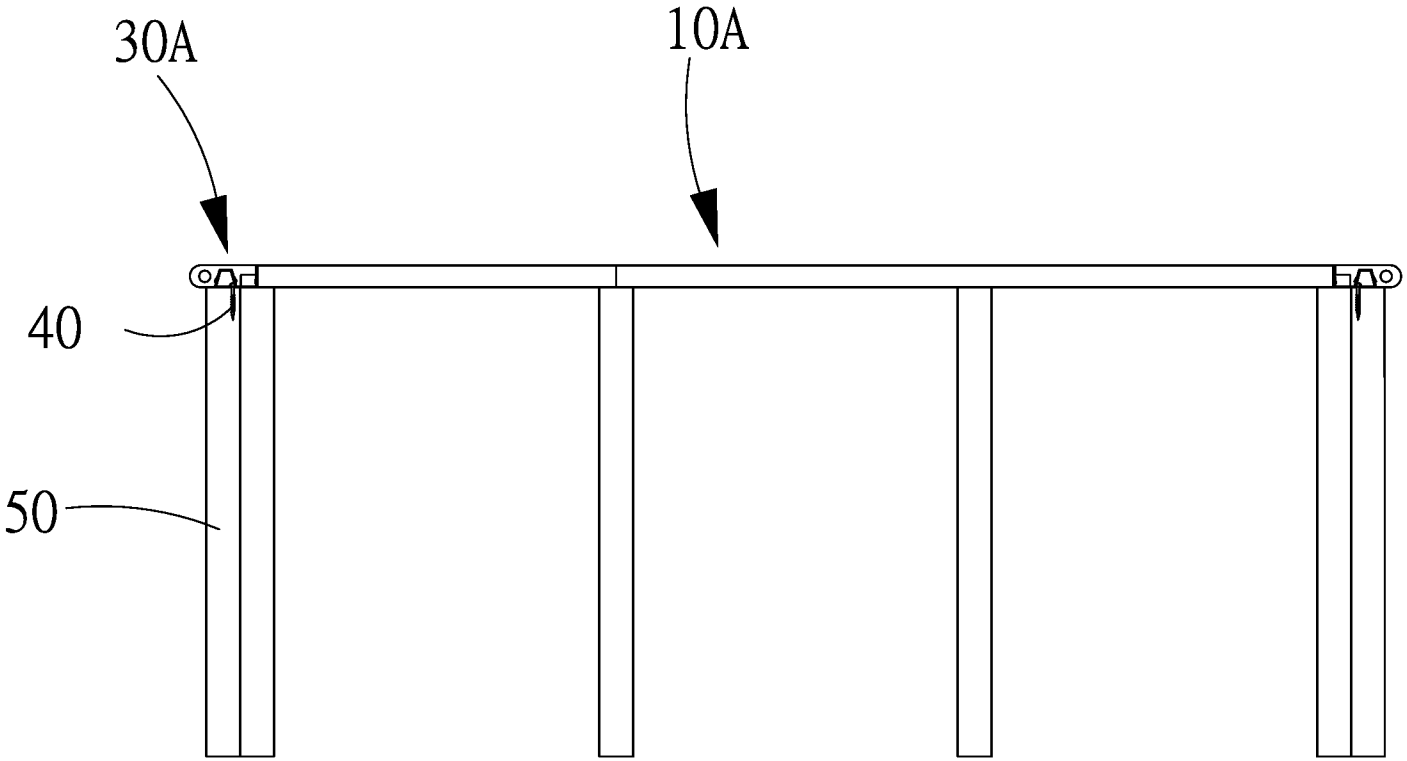
FIG. 9 is a cross-sectional view, in a schematic form, of FIG. 8.
Figure 10:
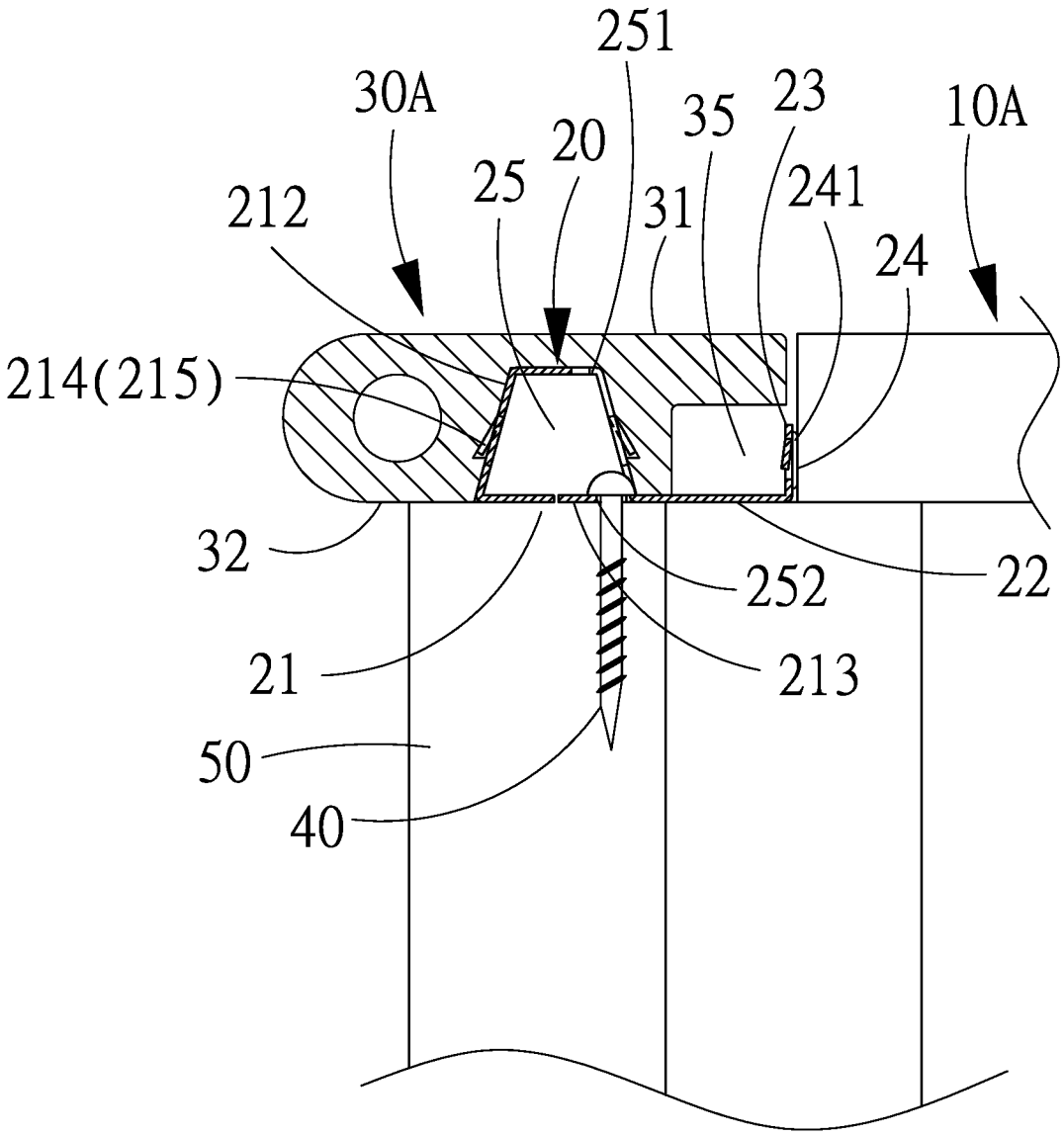
FIG. 10 is a cross-sectional view showing a portion of FIG. 9 in an assembled form.

Referring to FIGS. 7-10, another embodiment of the invention is provided for application to a floor board or a wall board, wherein the board members 10A are of a single-layered structure made of wood or plastics. As such, guide slot 111 and the barb space 112 shown in FIG. 3 are not necessary. Under such a condition, the first coupling unit 24 of the spring plate base 20 cannot be mounted to the board members 10A and the spring plate base 20 is arranged to have the preloading blocks 241 of the stop plate 23 abutting an outer end of the board members 10A, followed by having a fastening bolt 40 move through the opening 251 of the second coupling unit 25 and penetrate through the coupling hole 252, with correction or calibration being achieved with the marking sections 253, so as to have the bottom wall 213 of the hook-up seat 21 screwed to a riser member 50, a ground surface, or a wall at a predetermined location, allowing the hook-up seat 21 to be attached to the outer circumference of the board members 10A stably and securely at three points, including a fastening bolt 40 and the two preloading blocks 241 to enable the bottom portion 32 of the edge trimmer strip 30A to be arranged on and fixed to the hook-up seat 21 and the intermediate plate 22, achieving the purpose of easy and secured installation of the edge trimmer strip 30A. It is also noted that the edge trimmer strip 30A is preferably provided with a should slot 35 corresponding, in position, to the stop plate 23 so as to reduce a gap between the edge trimmer strip 30A and the board members 10A as much as possible.

It is known from the above description that the present invention possesses at least the following advantages:

(1) The edge trimmer strip 30, 30A according to the present invention is mounted to the hook-up seat 21 of the spring plate base 20 by means of the positioning groove 33 and the retaining notch 34 so that the operation of mounting can be carried out quickly without using any hand tool, such as a screwdriver or a spanner and such an operation can be easily achieved by using a hand to press down the edge trimmer strip 30, 30A, whereby advantages such as installing the edge trimmer strip 30, 30A in a time-efficient and fast manner can be achieved. In addition the positioning groove 33 of the edge trimmer strip 30, 30A and the spring plate base 20 are combinable together in a manner of being fit to each other to be retained in a reversed direction and being strong enough to support treading forces and impact forces applied in the same direction as that in which the fitting is made, so that the entire structure is securely fixed and robust without being readily loosened. It is noted that this invention can be detached by using a screwdriver or other hand tool to hit sideways. By having the retaining notches 34 of the edge trimmer strip 30, 30A disengage from the front hook-up tab 214 and the rear hook-up tab 215, the engaged and combined state between the edge trimmer strip 30, 30A and the spring plate base 20 can be released in an effort-saving manner Thus, the present invention provides an advantage of easily dismounting.

(2) The bottom portion of edge trimmer strip 30, 30A of the present invention is mounted, through the positioning groove 33 and the retaining notches 34, to the hook-up seat 21 of the spring plate base 20, so that the outside appearance of the edge trimmer strip 30, 30A would not be affected.

(3) The spring plate base 20 of the present invention is structured to have the stop plate 23 spaced from the hook-up seat 21 by a predetermined distance with the intermediate plate 22, so as to provide the bottom portion of the edge trimmer strip 30, 30A with a large surface area for assembling. Compared to the prior art, this effectively increases the surface area of the top portion of the edge trimmer strip 30, 30A for stylish shape so that the edge trimmer strip 30, 30A is provided, in respect of the outside configuration thereof, with an enlarged space for variation.

(4) The spring plate base 20 of the present invention could be mounted to an outer circumference of the board members 10, 10A by means of the first coupling unit or the second coupling unit. Thus, it is possible to select, if desired for certain applications, board members 10, 10A of a more suitable model in consideration of the requirements concerning cost and site. Thus, the spring plate base 20 of the present invention provide better compatibility.

(5) The edge trimmer strip 30, 30A of the present invention has a size that is much smaller and much more simplified than the prior art decoration board, so as to provide, in the entirety, an outside looking of better quality and a further reduced expense.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An edge finishing structure, comprising at least a spring plate base and an edge trimmer strip, wherein the spring plate base comprises a hook-up seat, an intermediate plate extending outward from one side of a lower end of the hook-up seat, and a stop plate connected to an outer side of the intermediate plate, the spring plate base being also provided with at least one coupling unit; and the edge trimmer strip has a bottom portion set on and mounted to the hook-up seat and the intermediate plate, the bottom portion of the edge trimmer strip being formed with a positioning groove corresponding to the hook-up seat;

wherein the hook-up seat is formed with a U-shaped punched hole having a uncut top side to form an awning window shaped hook-up tab, the hook-up tab being arranged to project outward of an outside surface of one of two opposite side walls of the hook-up seat in downward extension; and the edge trimmer strip is formed with a retaining notch in the positioning groove for engagement with the hook-up tab in an elastically deformable manner; the hook-up seat comprises a hollow frame.

2. The edge finishing structure according to claim 1, wherein the hollow frame has a trapezoidal cross-section shape having a top wall, the two opposite side walls, and a bottom wall.

3. The edge finishing structure according to claim 2, wherein the intermediate plate extends outward, in a horizontal direction, from a right side of a lower end of the hook-up seat and the stop plate extends upward, in a vertical direction, from a right side of the intermediate plate.

4. The edge finishing structure according to claim 3, wherein the first coupling unit comprises two preloading blocks that are formed on the stop plate through pressing to protrude rightward and a U-shaped punched hole arranged between the two preloading blocks and having an uncut top side to form an awning window shaped the barb tab, the barb tab being arranged to project outward of a left side of the stop plate in downward extension thereof.

5. The edge finishing structure according to claim 1, wherein the spring plate base comprises a first coupling unit formed in the stop plate and a second coupling unit formed in the hook-up seat, the second coupling unit and the first coupling unit being selectively operable to mount the hook-up seat to an external circumference of a board member.

6. The edge finishing structure according to claim 5, wherein the board member is formed of a foundation layer on which an extruding layer is stacked, the foundation layer being formed with a guide slot having an opening facing downward, the guide slot comprising a barb space that is provided in an upper portion thereof; and the first coupling unit comprises a preloading block protruding from one side of the stop plate and a barb tab that is formed of a U-shaped punched hole having an uncut top side, the barb tab being arranged to project outward of an opposite side of the stop plate in downward extension thereof, the preloading block and the barb tab being forcibly pushable to insert into the guide slot to be released inside the barb space so as to have the barb tab retained in the barb space to fix the hook-up seat to the external circumference of the board member.

7. The edge finishing structure according to claim 5, wherein the second coupling unit comprises a coupling hole formed in the hook-up seat; the board member is of a single-layered structure, the spring plate base being arranged to have the stop plate abutting an external end of the board member and a fastening bolt being received through the coupling hole to fix the hook-up seat at a predetermined location so as to fix the hook-up seat at the external circumference of the board members; and the edge trimmer strip is provided with a shoulder slot that corresponds, in position, to the stop plate.

8. The edge finishing structure according to claim 7, wherein the hook-up seat comprises a hollow frame having a trapezoidal cross-section shape having a top wall, two opposite side walls, and a bottom wall, the two side walls each having a front portion and a rear portion formed with hook-up tabs, the edge trimmer strip being provided with retaining notches in the positioning groove for engagement with the hook-up tabs in an elastically deformable manner; and the second coupling unit comprises an opening formed in the top wall and the side walls of the hook-up seat, the bottom wall of the hook-up seat being formed with a coupling hole corresponding to the opening.

9. The edge finishing structure according to claim 8, wherein the bottom wall is provided with a marking section at the coupling hole.

10. The edge finishing structure according to claim 1, wherein the spring plate base comprises a first coupling unit formed in the stop plate and a second coupling unit formed in the hook-up seat, the second coupling unit and the first coupling unit being selectively operable to mount the hook-up seat to an external circumference of a board member.

11. The edge finishing structure according to claim 10, wherein the board member is formed of a foundation layer on which an extruding layer is stacked, the foundation layer being formed with a guide slot having an opening facing downward, the guide slot comprising a barb space that is provided in an upper portion thereof; and the first coupling unit comprises a preloading block protruding from one side of the stop plate and a barb tab that is formed of a U-shaped punched hole having an uncut top side, the barb tab being arranged to project outward of an opposite side of the stop plate in downward extension thereof, the preloading block and the barb tab being forcibly pushable to insert into the guide slot to be released inside the barb space so as to have the barb tab retained in the barb space to fix the hook-up seat to the external circumference of the board member.

12. The edge finishing structure according to claim 10, wherein the second coupling unit comprises a coupling hole formed in the hook-up seat; the board member is of a single-layered structure, the spring plate base being arranged to have the stop plate abutting an external end of the board member and a fastening bolt being received through the coupling hole to fix the hook-up seat at a predetermined location so as to fix the hook-up seat at the external circumference of the board members; and the edge trimmer strip is provided with a shoulder slot that corresponds, in position, to the stop plate.

13. The edge finishing structure according to claim 12, wherein the hook-up seat comprises a hollow frame having a trapezoidal cross-section shape having a top wall, two opposite side walls, and a bottom wall, the two side walls each having a front portion and a rear portion formed with hook-up tabs, the edge trimmer strip being provided with retaining notches in the positioning groove for engagement with the hook-up tabs in an elastically deformable manner; and the second coupling unit comprises an opening formed in the top wall and the side walls of the hook-up seat, the bottom wall of the hook-up seat being formed with a coupling hole corresponding to the opening.

14. The edge finishing structure according to claim 13, wherein the bottom wall is provided with a marking section at the coupling hole.

15. The edge finishing structure according to claim 1, wherein the intermediate plate extends outward, in a horizontal direction, from a right side of a lower end of the hook-up seat and the stop plate extends upward, in a vertical direction, from a right side of the intermediate plate.

16. The edge finishing structure according to claim 15, wherein the first coupling unit comprises two preloading blocks that are formed on the stop plate through pressing to protrude rightward and a U-shaped punched hole arranged between the two preloading blocks and having an uncut top side to form an awning window shaped the barb tab, the barb tab being arranged to project outward of a left side of the stop plate in downward extension thereof.

17. The edge finishing structure according to claim 1, wherein the intermediate plate extends outward, in a horizontal direction, from a right side of a lower end of the hook-up seat and the stop plate extends upward, in a vertical direction, from a right side of the intermediate plate.

18. The edge finishing structure according to claim 17, wherein the first coupling unit comprises two preloading blocks that are formed on the stop plate through pressing to protrude rightward and a U-shaped punched hole arranged between the two preloading blocks and having an uncut top side to form an awning window shaped the barb tab, the barb tab being arranged to project outward of a left side of the stop plate in downward extension thereof.

* * * * *